US008550242B2

(12) United States Patent
Minarelli

(10) Patent No.: US 8,550,242 B2
(45) Date of Patent: Oct. 8, 2013

(54) ADHESIVE-PERMEABLE STRIP CONTAINER, A RELATIVE BLANK, AND A METHOD OF MANUFACTURING THE CONTAINER

(75) Inventor: Alessandro Minarelli, Albino (IT)

(73) Assignee: G.D. S.p.A. (IT)

( * ) Notice: Subject to any disclaimer, the term of this patent is extended or adjusted under 35 U.S.C. 154(b) by 0 days.

(21) Appl. No.: 13/381,596

(22) PCT Filed: Jul. 26, 2010

(86) PCT No.: PCT/IB2010/053378

§ 371 (c)(1),
(2), (4) Date: Dec. 29, 2011

(87) PCT Pub. No.: WO2011/024088

PCT Pub. Date: Mar. 3, 2011

(65) Prior Publication Data

US 2012/0103859 A1 May 3, 2012

(30) Foreign Application Priority Data

Aug. 28, 2009 (IT) ..... BO2009A0556

(51) Int. Cl.
*B65D 85/10* (2006.01)
*B65D 5/44* (2006.01)

(52) U.S. Cl.
USPC ..... 206/273; 206/268; 229/5.81; 229/160.1; 229/198.1

(58) Field of Classification Search
USPC ..... 206/259, 264, 265, 268, 271–275; 229/160.1, 198.1, 198.2, 5.81
See application file for complete search history.

(56) References Cited

U.S. PATENT DOCUMENTS

| | | | | |
|---|---|---|---|---|
| 5,732,825 | A | 3/1998 | Ikenoya et al. | |
| 6,149,052 | A | 11/2000 | Mueller | |
| 7,290,652 | B2 * | 11/2007 | Rath | 206/271 |
| 7,762,046 | B2 * | 7/2010 | Pipes et al. | 206/273 |
| 2003/0116614 | A1 * | 6/2003 | Block et al. | 229/160.1 |
| 2005/0087460 | A1 * | 4/2005 | Bruhn et al. | 206/273 |
| 2005/0274633 | A1 * | 12/2005 | Ako | 206/271 |

FOREIGN PATENT DOCUMENTS

| | | |
|---|---|---|
| WO | 99/28212 | 6/1999 |
| WO | 02/079052 | 10/2002 |

OTHER PUBLICATIONS

International Search Report and Written Opinion dated Oct. 27, 2010.

* cited by examiner

*Primary Examiner* — Bryon Gehman
(74) *Attorney, Agent, or Firm* — Timothy J. Klima; Shuttleworth & Ingersoll, PLC

(57) ABSTRACT

A container comprises at least a first wall (2*a*) and a second wall (2*b*) presenting respective flaps (6) of plastic, plasticized or metallized material, engaging one with another in overlapping contact to interconnect the relative walls (2*a*, 2*b*). Each flap (6) is furnished with a strip (7) of material presenting a first face (7*a*) affixed to the flap (6), and a second face (7*b*), opposite from the first face (7*a*), able to retain a coating of liquid or paste adhesive; the second faces (7*b*) of the strips are bonded together to secure the joined flaps (6) one to another.

11 Claims, 2 Drawing Sheets

ADHESIVE-PERMEABLE STRIP CONTAINER, A RELATIVE BLANK, AND A METHOD OF MANUFACTURING THE CONTAINER

This application is the National Phase of International Application PCT/IB2010/053378 filed Jul. 26, 2010 which designated the U.S. and that International Application was published under PCT Article 21(2) in English.

This application claims priority to Italian Patent Application No. BO2009A000556 filed Aug. 28, 2009 and PCT Application No. PCT/IB2010/053378 filed Jul. 26, 2010, which applications are incorporated by reference herein.

TECHNICAL FIELD

The present invention relates to a container, a blank, and a method of manufacturing the container.

In particular, the present invention relates to a container for consumer products such as fragrances, soaps, jewels, and others besides.

By way of example, and with no limitation implied, the present invention relates to a packet for tobacco products such as cigarettes or cigars.

BACKGROUND ART

The prior art embraces containers having a substantially rigid outer wrapper fashioned from a diecut blank.

More exactly, the blank consists in a flat piece of wrapping material foldable along selectively placed crease lines and score lines that serve to mark out a succession of panels, and a number of flaps arranged in such a way as to overlap at predetermined fixing areas when the blank is folded to erect the container.

The method by which these flaps are joined together to erect the container generally involve applying a layer of adhesive to the aforementioned fixing areas, preferably a cold-setting glue, in such a way that when the flaps are paired together they will bond swiftly one to another.

While serviceable, the method in question is less effective when the flaps of the container, or indeed all parts of the container, are made of plastic, plasticized or metallized material.

In effect, such materials are impermeable and unable to retain conventional cold-setting glues, so that the flaps cannot be bonded together by this method.

In prior art manufacturing systems, this drawback is overcome by using hot melt adhesives, which when heated will also enable the aforementioned impermeable materials to be bonded.

Nonetheless, adhesives of this type come with a number of drawbacks and are generally disagreeable to end users.

Firstly, hot melt glues tend to give off unpleasant odours, even after curing, which can render the product unattractive and adversely affect its quality, especially in the case of containers holding cigarettes or fragrances.

Also, hot melt adhesives typically crystallize when cooled, sometimes becoming fragile and liable to fracture.

DISCLOSURE OF THE INVENTION

The object of the present invention is to provide a container unaffected by the drawbacks associated with the prior art, as mentioned above.

A further object of the present invention is to provide a simple and reliable method of manufacturing such a container.

Another object of the present invention is to provide a blank from which the container can be manufactured simply and securely.

The stated objects are realized in a container having features as recited herein, in a blank having features as recited herein, and in a method of manufacturing the container, having features as recited herein.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS

Figure 1:
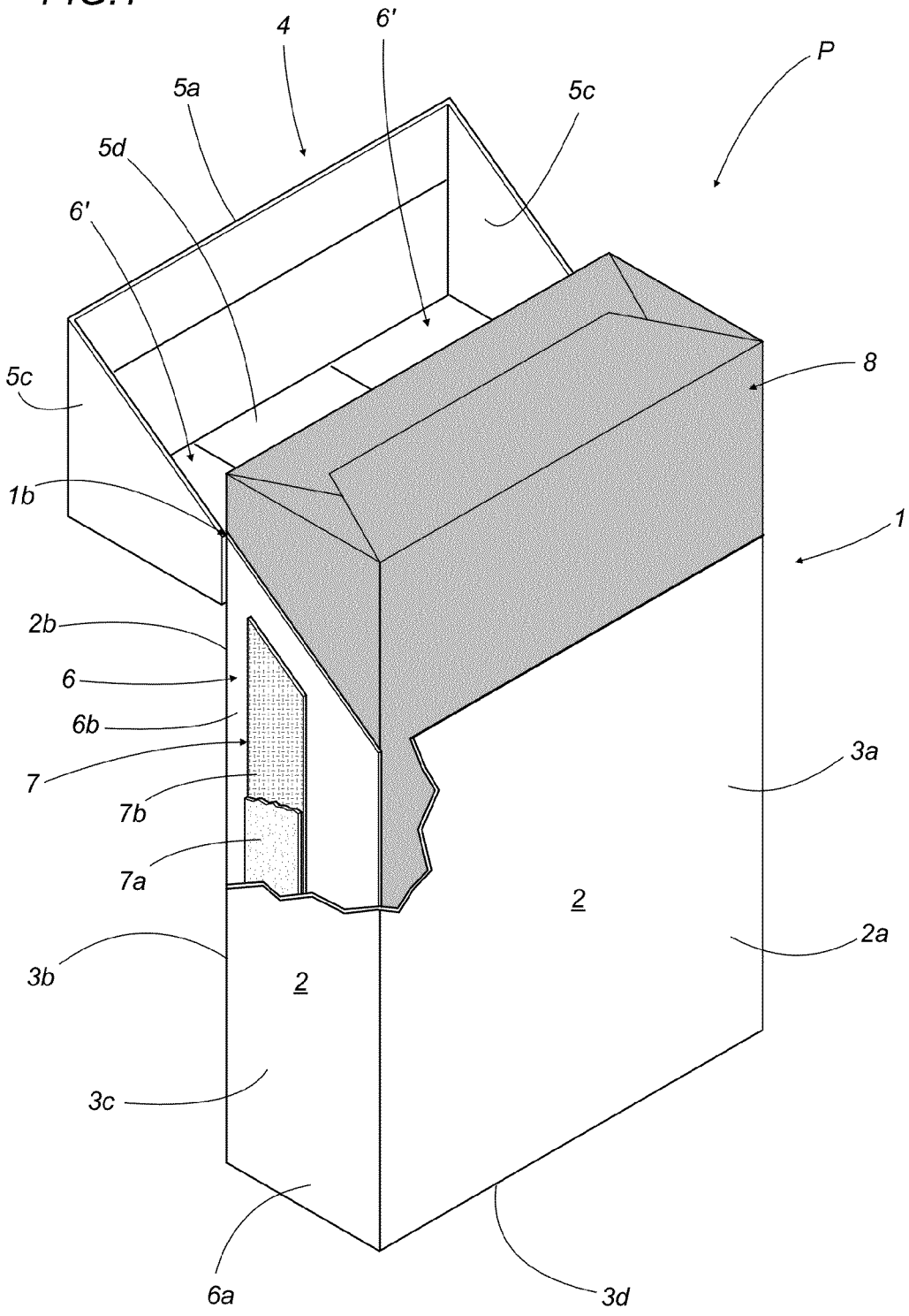
FIG. 1 shows a container embodied in accordance with the present invention, viewed in perspective and cut away in part to illustrate a detail of its construction.
Figure 2:
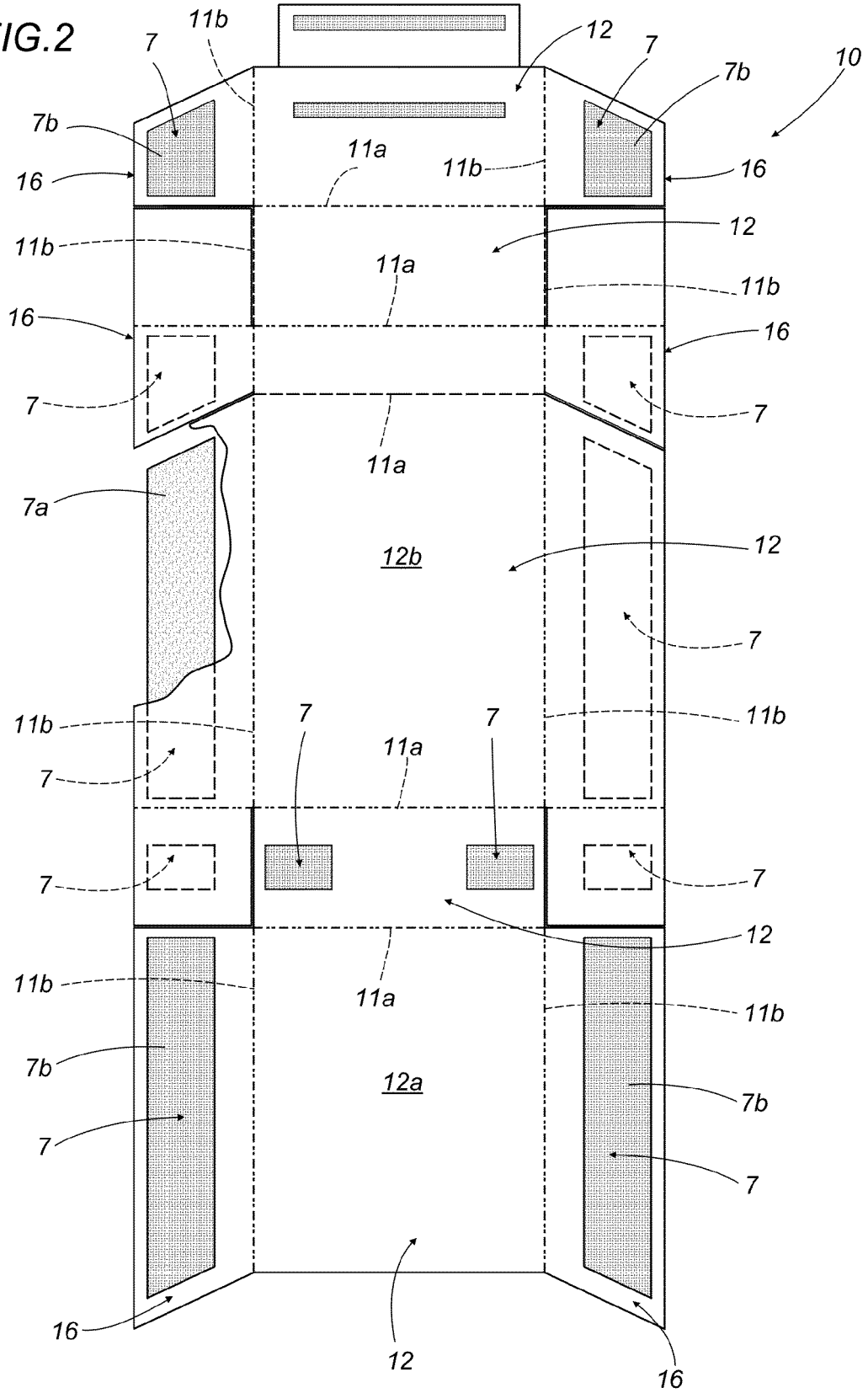
FIG. 2 shows a blank embodied in accordance with the present invention, viewed in plan and cut away in part to illustrate a detail of its construction.

With reference to FIGS. 1 and 2, numeral 1 denotes a container, in its entirety, embodied in accordance with the present invention.

By way of example, and therefore with no limitation implied, reference is made in the following specification to a packet for tobacco products such as cigarettes or cigars.

The container 1 forms part of the packet, denoted P, and presents an opening 1*a* through which to introduce or take out the aforementioned products (cigarettes or cigars). The packet P also comprises a lid 4, attached to the container 1 along a hinge line 1*b* and rotatable thus between positions in which the opening 1*a* is exposed and concealed, respectively.

The container 1 comprises a plurality of walls 2 connected one to another and delimiting an enclosure such as will hold a plurality of tobacco products, typically cigarettes or cigars. In the example illustrated, the tobacco products are enveloped by an inner wrapper 8 of packaging material.

The walls 2 are made of plastic, plasticized or metallized material.

In other words, the outer walls 2 of the container 1 (indeed of the packet P as a whole) are fashioned from a material substantially impermeable to liquids.

According to the present invention, the container 1 comprises at least a first wall 2*a* and a second wall 2*b* interconnected one with another. More exactly, the first wall 2*a* and the second wall 2*b* each present at least one respective connecting flap 6, and the flaps 6 engage one with another to interconnect the two respective walls 2.

In accordance with the invention, the flaps 6 consist in a plastic, plasticized or metallized material, that is to say the same material as the relative wall 2. In effect, each flap 6 and the relative wall 2 are fashioned in one piece.

In the example illustrated, the container 1 presents a front wall 3*a*, a rear wall 3*b*, two flank walls 3*c* and a bottom wall 3*d*.

More precisely, the front wall 3*a* and the rear wall 3*b* are disposed mutually parallel and facing one another, the flank walls 3*c* are disposed mutually parallel and facing one other, and transversely to the front wall 3*a* and the rear wall 3*b*, whilst the bottom wall 3*d* is disposed transversely to the front wall 3*a*, to the rear wall 3*b* and to the two flank walls 3*c*.

Thus, the walls 2 of the container 1 combine to establish a structure of substantially parallelepiped geometry.

Referring to FIG. 1, the first and second walls 2*a* and 2*b* coincide respectively with the front wall 3*a* and with the rear wall 3*b*.

In the example illustrated, the first wall 2*a* and the second wall 2*b* each present a pair of flaps 6*a* and 6*b* projecting laterally on either side from the selfsame first and second walls 2*a* and 2*b*, respectively. In particular, each flap 6*a* of the first wall 2*a* engages with a respective flap 6*b* of the second wall 2*b*.

In the example illustrated, accordingly, the two pairs of flaps 6 engage in overlapping contact to create two further walls 2*c* of the container, positioned between the first wall 2*a* and the second wall 2*b*. In practice, the aforementioned further walls 2*c* coincide with the aforementioned flank walls 3*c* presented by the container 1 of the packet P.

Numeral 7 denotes a strip associated with each flap 6, presenting a first face 7*a* secured to the flap 6, and a second face 7*b* on the side opposite to the first face 7*a*.

In a preferred embodiment of the container 1, the first face 7*a* of each strip 7 is coated with a layer of pressure-sensitive adhesive and affixable thus to the respective flap 6.

In other possible embodiments (not illustrated), the first face 7*a* of each strip 7 could be fixed to the respective flap 6 utilizing different types of adhesive, metal staples or other fastening media.

The flaps 6 on each side of the container are glued together by pairing the second faces 7*b* of the corresponding strips 7 one with another. The second face 7*b* of each flap 6 is made of a material able to retain a measure of cold-setting glue having a liquid or paste consistency. In this way, the flaps 6 can be bonded together using conventional cold-setting adhesives.

The second face 7*b* of each strip 7 consists preferably of a paper material, and in the preferred embodiment illustrated, the first face 7*a* of each strip 7 consists likewise of paper material. In short, each strip 7 is made entirely of paper material.

The foregoing description of the container is applicable in every respect to the lid 4 illustrated in FIG. 1. That is to say, the lid 4 comprises a plurality of walls 5, and in particular, a front wall 5*a*, a rear wall 5*b*, two flank walls 5*c* and a top wall 5*d*.

The walls 5 present respective pairs of flaps 6' engageable one with another, as in the case of the container 1, and interconnecting the respective front and rear walls 5.

The description of the flaps 6 associated with the walls 2 of the container 1 is applicable entirely to the flaps 6' associated with the walls 5 of the lid 4, thus illustrating a further application of the present invention.

With reference to FIG. 2 of the drawings, numeral 10 denotes a flat diecut blank from which to fashion the packet P illustrated in FIG. 1, by way of example.

The blank 10 comprises a plurality of panels 12 joined one to another, each constituting a respective wall 2 of the container 1 and/or a respective wall 5 of the lid 4 as described above.

In accordance with the present invention, the blank 10 comprises at least a first panel 12*a* and a second panel 12*b* constituting the first wall 2*a* and the second wall 2*b* of the container 1, respectively.

Each panel 12 presents at least one respective tab 16 corresponding to the flap 6 of the relative wall 2, and more exactly, a pair of tabs 16 positioned one on either side.

In the example illustrated, the blank 10 comprises six panels 12 constituting the front wall 3*a*, rear wall 3*b* and bottom wall 3*d* of the container 2, and the front wall 5*a*, rear wall 5*b* and top wall 5*d* of the lid 4, respectively.

In the preferred embodiment illustrated, each panel 12 is connected hingedly to an adjoining panel 12 along a relative crease line 11*a*. In addition, each tab 16 is connected to the respective panel 12 along a further crease line 11*b*.

As illustrated in FIG. 2, the crease lines 11*a* first mentioned extend transversely to the further crease lines 11*b*.

Each tab 16 is furnished with one of the strips 7 described previously, each positioned with the first face 7*a* secured to the respective tab 16 and presenting the second face 7*b* fashioned from a material such as will retain a measure of adhesive having a liquid or paste consistency.

To reiterate, the first face 7*a* of each strip 7 is coated with a layer of pressure-sensitive adhesive and affixable thus to the respective tab 16.

The present invention relates also to a method of manufacturing the container 1 described and illustrated.

The first step of such a method will be to prepare a blank 10 as described above.

Having prepared the blank 10, a measure of liquid adhesive is deposited on at least one strip 7 associated with each pair of tabs 16 to be joined together (this particular step can be implemented either within the compass of a packaging machine, or beforehand, during the preparation of the blanks 10).

The blank 10 is then folded along the aforementioned crease lines 11*a* and 11*b* so as to join the corresponding tabs 16 together, bringing the parts of the respective strips 7 coated with adhesive into contact one with another.

Finally, the folded blank 10 must be held in position for a duration sufficient to dry the liquid adhesive and interlock the panels 12 to fashion the container 1.

In an alternative version of the method disclosed, the step of preparing the blank 10 includes two subsidiary steps.

More exactly, the preparation step is accomplished by procuring a blank without the strips 7 (not illustrated), and subsequently affixing a strip 7 to each of the tabs 16.

Still more exactly, the affixing step is accomplished by positioning each strip 7 on the respective tab 16 and then applying pressure in such a way as to activate the pressure-sensitive adhesive with which the first face 7*a* of the selfsame strip 7 is coated.

In the preferred embodiment illustrated, the strip 7 is of elongated appearance, that is to say preferably with one only of the two main dimensions predominating, in such a way as to obtain a gluing surface that extends substantially along the entire length of the tab 16.

In other possible embodiments (not illustrated), the appearance of the single strip 7 might be other than elongated; for example, strips 7 of square or rounded appearance might be utilized.

The stated objects are achieved by the invention, which affords significant advantages.

In effect, a container according to the present invention is simple to produce, inasmuch as it can be manufactured on machines widely used for erecting containers from ordinary diecut blanks of paperboard type material.

Thanks to the adoption of the aforementioned strips, in particular, it becomes possible to used cold-setting adhesives even for securing flaps of plastic, plasticized or metallized material, thereby avoiding the fragility problems experienced with hot melt adhesives.

Again, given that there is no need for adhesives to be heated, as in the case of hot melt products, the method disclosed for manufacturing packets of this type offers notable ease of implementation.

Moreover, the use of cold-setting adhesives is instrumental in ensuring that the aroma of products packaged in plastic, plasticized or metallized containers will not be affected by the unpleasant odour associated with hot melt adhesives.

This is a particularly significant advantage in the event that the container should be a packet for tobacco products such as cigarettes or cigars, given that the unpleasant odour given off by hot melt adhesives tends to affect not only the aroma, but also the taste, and ultimately the quality of the product in the packet.

The invention claimed is:

1. A container comprising:

at least a first wall and a second wall, each including a connecting flap of a liquid impermeable material; the flaps engaging one with another to interconnect the first and second walls;

each flap including a strip comprising a first face affixed to the flap and a second face, on a side opposite to the first face, configured to retain an amount of a first adhesive in at least one chosen from liquid and paste form;

wherein the second faces are joined together to connect the corresponding flaps one to another;

wherein each strip is made entirely of paper material and is permeable to retain the first adhesive.

2. The container of claim 1, wherein the first adhesive is a cold-setting glue.

3. The container of claim 1, wherein the first face of each strip is coated with a layer of pressure-sensitive adhesive to affix the strip to the flap.

4. The container of claim 1, wherein the flaps are overlappable one with another to create a further wall of the container, interconnecting the first wall and the second wall.

5. A blank from which to manufacture the container of claim 1, comprising:

at least a first panel and a second panel coinciding respectively with the first wall and the second wall of the container, each panel including at least one tab constituting the flap of the respective wall;

wherein each tab includes one of the strips with the first face affixed to the tab.

6. The blank of claim 5, wherein the first face of each strip is coated with a layer of pressure-sensitive adhesive to affix the strip to the tab.

7. A method of manufacturing a container, comprising:

preparing a container comprising:

at least a first wall and a second wall, each including a connecting flap of a liquid impermeable material; the flaps engaging one with another to interconnect the first and second walls;

each flap including a strip comprising a first face affixed to the flap and a second face, on a side opposite to the first face, configured to retain an amount of a first adhesive in at least one chosen from liquid and paste form;

wherein the second faces are joined together to connect the corresponding flaps one to another;

wherein each strip is made entirely of paper material and is permeable to retain the first adhesive;

preparing a blank comprising at least a first panel and a second panel coinciding respectively with the first wall and the second wall of the container in production; each panel presenting at least one respective tab constituting the flap of the respective wall;

affixing the strip to each tab;

applying the amount of first adhesive to at least one strip;

folding the blank to join the tabs and bring together the parts of the respective strips coated with the first adhesive;

holding the shape of the folded blank for a duration sufficient to dry the first adhesive and interlock the panels to fashion the container.

8. The method of claim 7, wherein the liquid impermeable material is one of plastic, plasticized material and metallized material.

9. The method of claim 7, wherein the first face of each strip is coated with a layer of pressure-sensitive adhesive, and the step of affixing a strip to each tab includes the steps of positioning the strip on the respective tab and pressing the strip against the tab to activate the first adhesive.

10. The method of claim 7, wherein the step of applying the first adhesive to each strip includes applying a cold-setting glue to each strip.

11. The method of claim 7, wherein the liquid impermeable material is one of plastic, plasticized material and metallized material.

* * * * *